United States Patent [19]

Baker et al.

[11] 4,416,339

[45] Nov. 22, 1983

[54] BIT GUIDANCE DEVICE AND METHOD

[76] Inventors: Royce E. Baker, P.O. Box 1377, Medina, Tex. 78055; Glennwood Singletary, Rte. 6, Box 510, Hickory, N.C. 28601

[21] Appl. No.: 341,472

[22] Filed: Jan. 21, 1982

[51] Int. Cl.[3] ..... E21B 7/04

[52] U.S. Cl. ..... 175/61; 175/73; 175/76; 175/77

[58] Field of Search ..... 175/61, 73, 76, 77, 175/45

[56] References Cited

U.S. PATENT DOCUMENTS

| | | | |
|---|---|---|---|
| 3,023,821 | 3/1962 | Etherington | 175/61 |
| 3,092,188 | 6/1963 | Farris et al. | 175/76 |
| 3,243,001 | 3/1966 | Vincent | 175/73 |
| 3,554,302 | 1/1971 | Adkins et al. | 175/73 X |

OTHER PUBLICATIONS

Whipco Rebel Tool Brochure, 4 pages.
World Oil *Straight Hole Drilling* article; copyright 1963,
A-1 Bowen Whipstocks Instruction Manual.
Scientific Drilling Controls Brochure.

*Primary Examiner*—Ernest R. Purser
*Assistant Examiner*—Thuy M. Bui

[57] ABSTRACT

The invention disclosed herein provides a mechanism and method for positive drill bit guidance during well drilling operations. The guidance device includes a control arm or paddle which, due to hydraulic pressure, pivots to steer the drill bit towards its target area. As the paddle applies pressure to the wall of the well, the drill bit is then turned from the contacted area of the well wall in the desired direction.

13 Claims, 5 Drawing Figures

BIT GUIDANCE DEVICE AND METHOD

BACKGROUND AND OBJECTIVES OF THE INVENTION

During well drilling operations both on shore and off drillers are constantly plagued with controlling the direction of the drill bit on its course to the target area. It is not uncommon for drilling rigs to be some two to twelve thousand feet from the platform and even with the utmost in planning and testing the drill bit can laterally drift from its intended direction. The success or failure of a drilling operation can depend on a relative few feet of accuracy and due to the soaring cost to companies over the past several years for exploration, on-target drilling accuracy remains a top priority.

The lateral drift of a drill bit can be caused by various factors including the torque of the drill bit as it rotates, the density or structure of the particular stratum and other factors which can create problems for the driller.

Various methods and devices have been utilized in the past to compensate for the sidelong movement of the drill bit, but none have proved satisfactory under a variety of adverse conditions and their benefits have often been less than satisfactory.

With this background in mind, the present device and method were developed and one of the main objectives is to insure accuracy in directing the drill bit to its intended target area.

Another objective of the present invention is to positively counteract the lateral drift which occurs during well drilling operations.

Still another objective of the present invention is to provide a device and method which is economical to construct and use and which will work in various types of bed formations.

Another objective of the present invention is to provide a device which will give positive guidance to a drill bit even during the encounter of viscid substances.

It is still another objective of the present invention to provide a method of drill bit guidance which can easily be learned by drillers in a relatively short time.

DESCRIPTION OF THE PREFERRED EMBODIMENT

The preferred embodiment of the drill bit guidance device of the present invention includes a piston means and paddle member which is adpated to a drill collar positioned next to the drill bit. The paddle member is positioned in close proximity to the drill bit to give the guidance device maximum effective control as it is operated. The piston means includes a gate means which is controlled by centrifugal force and gravity which opens and closes ports which are in communication with the piston cylinder. Thus, when the gate means is opened fluid passes from the collar member through the gate means to drive a piston outwardly towards a pivotally mounted paddle member located on the exterior surface of the collar. The paddle member thus strikes the well wall and causes the drill bit to carom away from the contacted area. The gate means only opens during a specific arc of the collar's revolution as the gate means is influenced by the centrifugal force developed during rotation and by the action of gravity. The guidance device also includes an exit port, a pressure release means and a well venting port. The paddle member pivots to strike the wall of the well under a positive force, namely the extention of the piston rod to thereby give the driller control even when drilling through gummy or tarry materials which may prevent the operation of conventional devices.

In the preferred method of operation of the guidance device drilling fluid as normally utilized is forced down the drill collar through its fluid conduit under varying pressures, which may be for example, 3,000 psi. The guidance device which is located above the drill bit rotates with the drill bit and is not operational at conventional drilling speeds (approximately 100–300 rpm). As the rotational speed is decreased the guidance device becomes operative due to a lessening of centrifugal force and the gate means of the piston means will then oscillate and open as it rotated and fluid is forced under pressure into the piston means to cause pivoting of the paddle member in contact therewith. As the gate means falls to its lower position during the first part of the revolution drilling fluid is forced into the piston means driving the piston rod outwardly towards the paddle member. Later during the same revolution the gate means, under gravitational influence, oscillates forward in the same direction as the drill bit but at a higher rpm to close the fluid entry port of the piston means. Simultaneously as the gate means rotates forward it opens the exit port of the piston means to allow the pressurized fluid in the piston means to escape back to the fluid conduit of the collar. Thus, the paddle member is urged outwardly by the piston rod during a fraction of the rotational cycle of the drill bit and is allowed to return during a later part of the same cycle as pressure is reduced in the piston means.

DESCRIPTION OF THE DRAWINGS

For a more detailed description of the drawings, FIG. 1 illustrates an off shore oil drilling platform and various strata 11 with drilling apparatus 12. Drilling apparatus 12 includes collar member 13, paddle member 14 and drill bit 15. Drill bit 15 includes fluid jets 16 and cone members 17. Drilling apparatus 12 as shown in FIG. 1 is conventional with the exception of collar member 13 with paddle member 14 incorporated therein.

Figure 2:
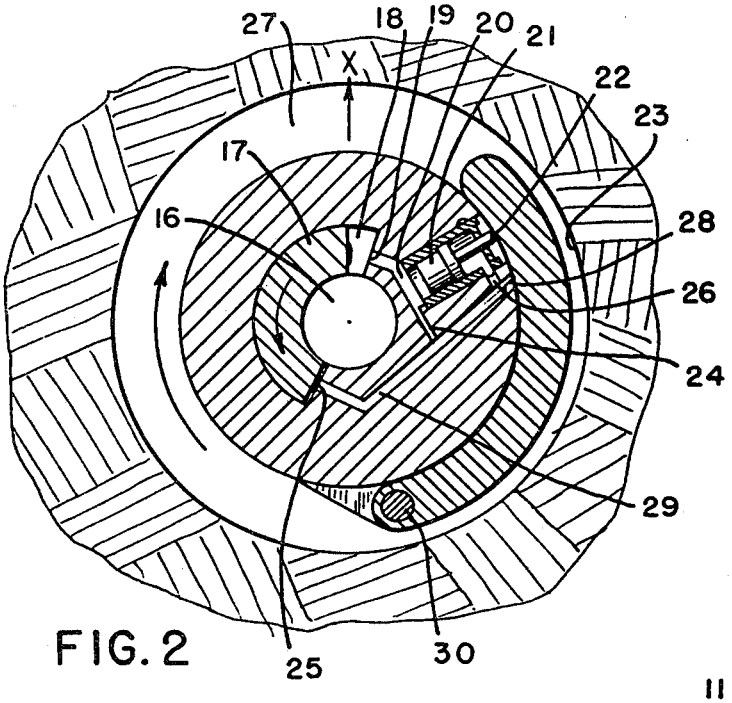
FIG. 2 is a cross sectional view of the collar member along lines 2—2 of FIG. 1 with the present invention incorporated therewith.
Figure 3:
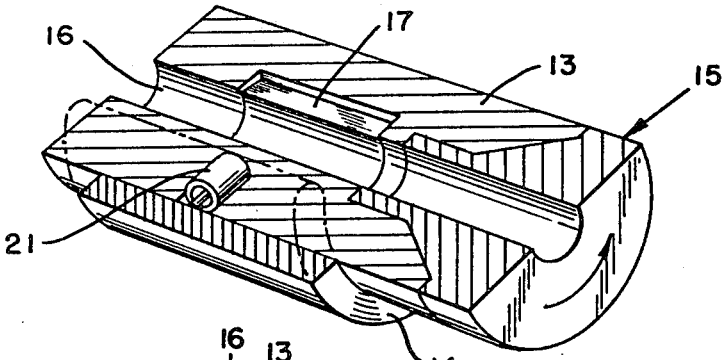
FIG. 3 is yet another cross sectional view of the device of the present invention.
Figure 1:
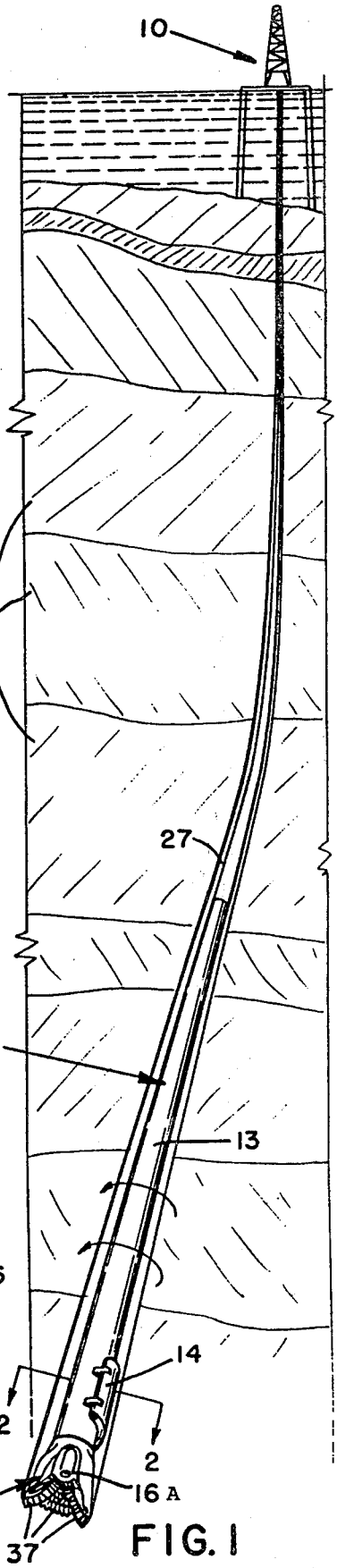
FIG. 1 is a perspective view of a schematic off shore oil drilling operation utilizing the present invention.
Figure 2:
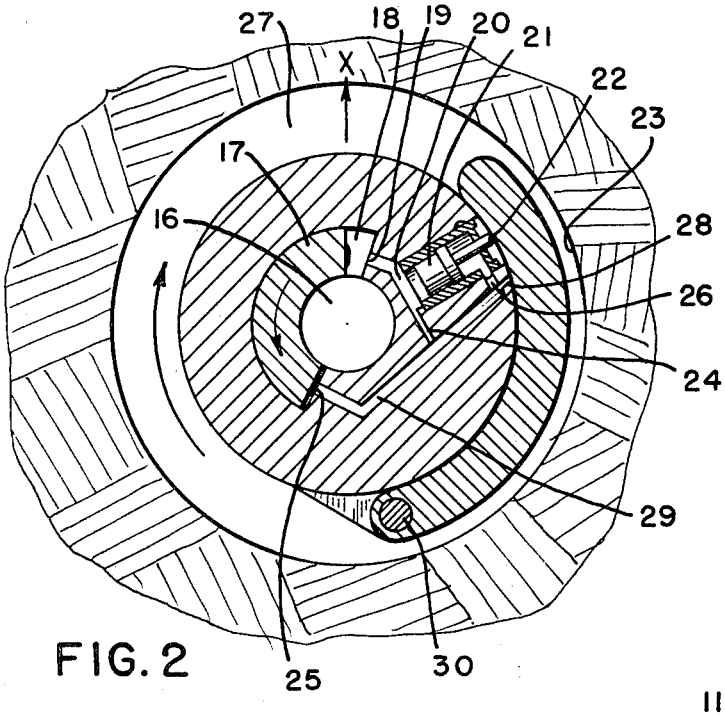
Figure 3:
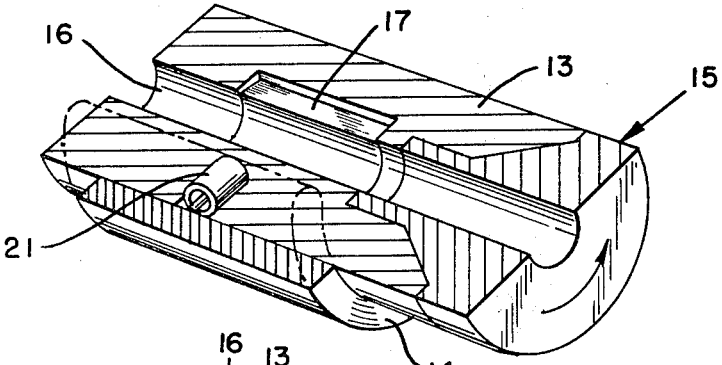
Figure 4:
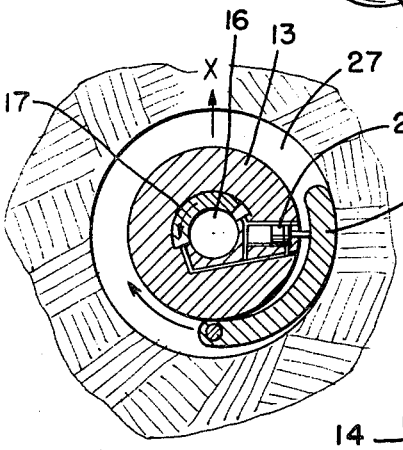
Figure 5:
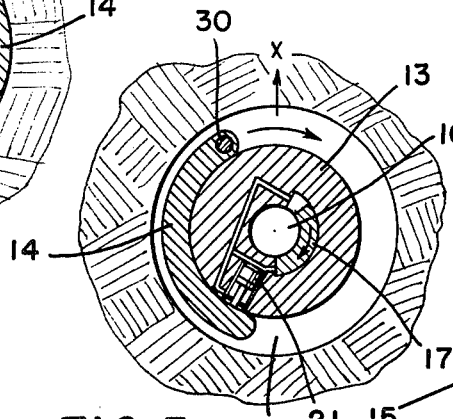
Figure 1:
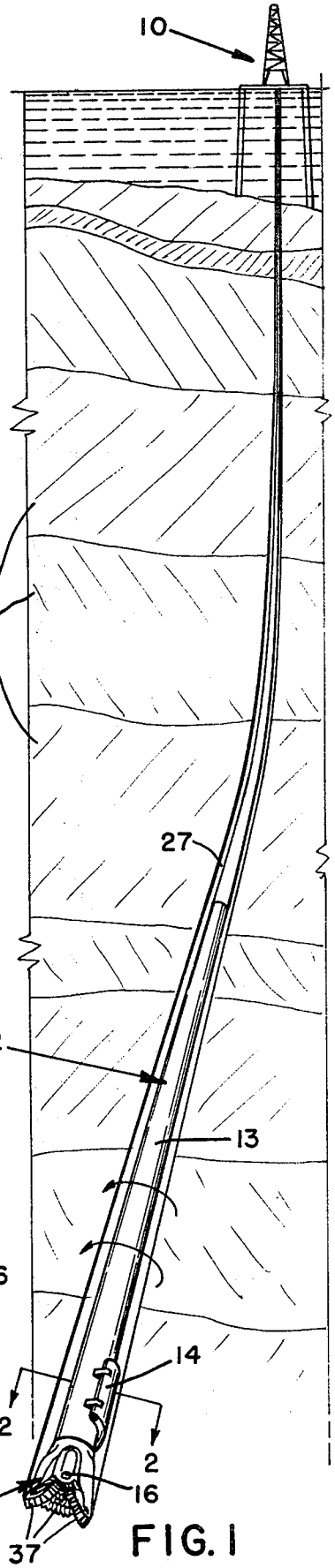

Paddle member 14 is shown pivotally mounted to collar 13 in FIG. 2 by hinge pin 30. Collar member 13 includes a central conduit 16 through which drilling fluid is pumped under pressure from a fluid supply (not shown) on platform 10 to drill bit 15 as is conventionally done. The drilling fluid exit jets 16A and provides lubrication to cone members 37 as shown in FIG. 1 and as is well known drilling fluid is forced under pressure through conduit 16 to drive the drill bit cone 17 and is in the pressure range of approximately 3,000 psi. The spent drilling fluid mixes with the well waste and is forced upwardly along the outer diameter of collar 13 and returns to platform 10 for disposal. Such waste may be extremely tenacious or gummy and may cause problems for convention bit guidance apparatus that must function in the gummy waste under certain circumstances.

As further shown in FIG. 2 gate means 17 oscillates within its trench 18 and is influenced by the rotational speed of the drill bit and by the force of gravity and centrifugal force as will be further explained below. As gate means 17 opens as is shown in FIG. 2, drilling fluid (not shown) is forced from fluid conduit 16 into trench 18. Entry port 19 is thereby opened and the drilling fluid passes into piston channel 20 whereupon hydraulic pressure is then applied to piston head 21. As pressure is applied to piston head 21 and piston rod 22 move readily outward causing paddle member 14 to pivot about hinge pin 30. As paddle member 14 opens it quickly strikes well wall 23 causing the drilling apparatus 12 to carom or recoil away from the impact point. Therefore, lateral drift can be compensated for by periodically extending paddle member 14 causing drill bit 15 to recoil thereby correcting the lateral direction towards the target area.

As further shown in FIG. 2, a small amount of fluid is allowed to pass through relief channel 24 when gate means 17 is in its opened position to relieve any pressure lock on exit port 25. As piston head 21 moves readily outward pressure abateing channel 26 is encountered which serves to neutralize the force on piston head 21 and consequently lessens the positive pressure on paddle member 14. Excess fluid under pressure which enters abateing channel 26 would then exit into well 27 through well venting port 28.

Figure 4:
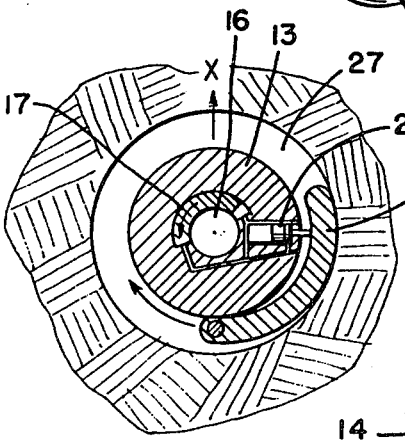
FIG. 4 demonstrates the invention with the paddle member pivoted outwardly contacting the well wall.

As the drill bit and collar rotate in a clockwise direction at a relatively low rpm as shown in FIG. 2 after gate means 17 opens, paddle member 14 extends as shown in FIG. 4 to contact well wall 23. Thereafter as collar member 13 continues its clockwise rotation whereupon gate means 17, under the influence of gravity, falls to close entry port 19 as shown in FIG. 2. As entry port 19 is closed exit port 25 is opened and fluid in piston channel 20 is then forced along exit channel 29 through trench 18 and on into fluid conduit 16. Excess drilling fluid is vented in the well 27 through well venting port 28 also during this portion of the rotational cycle.

Figure 5:
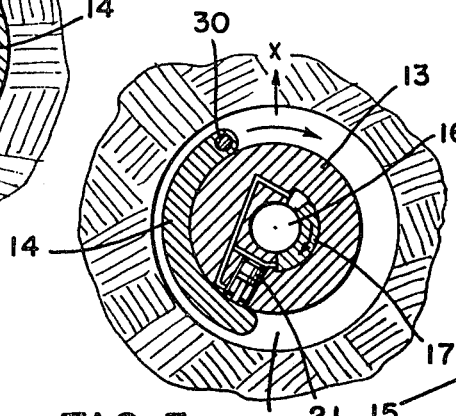
FIG. 5 demonstrates the paddle member retracted from its extended position.

As would be understood from FIGS. 2, 4 and 5, gate means 17 oscillates within trench 18 and under the influence of gravity falls to the lower part of trench 18. Additionally, in order to overcome the gravitational influence on gate means 17 drilling apparatus 12 can be rotated at a high speed for example, in excess of 100 rpms, and the centrifugal force developed will surpass the gravitational influence on gate means 17 and prevent it from oscillating. Thus, by reducing the rotational speed of the drill bit and collar member as is done by conventional methods (to approximately 60 rpm or below) gate means 17 will thereby oscillate in trench 18 and the invention as described herein will begin to function and the lateral shift in the drilling direction will occur. When the drift has been sufficiently corrected, the rotational speed is increased (to approximately 100 rpms or above) whereupon centrifugal force will prevent gate means 17 from oscillating. As is understood the present invention will operate when the drilling apparatus is at an angle to the vertical, i.e. when drilling is done other than straight down.

Various modifications and changes can be made to the present invention and the illustrations and examples as shown herein are not intended to limit the scope of the invention.

We claim:

1. A drill bit guidance device comprising: a collar member, a piston means, said piston means having a paddle member, said paddle member pivotably joined to said collar member, said collar member having a fluid conduit, said fluid conduit communicating with said piston means, a gate means, said gate means within said collar member, said gate means oscillatable around said fluid conduit, a fluid supply means, said fluid supply means communicating with said fluid conduit whereby said fluid from said supply means is directed through said fluid conduit to said gate means to allow said piston means to pivot said paddle member.

2. A drill bit guidance device as claimed in claim 1 wherein said piston means includes a gate means.

3. A drill bit guidance device as claimed in claim 2 wherein said gate means is controlled by centrifugal force.

4. A drill bit guidance device as claimed in claim 1 wherein said piston means includes fluid entry and exit ports.

5. A drill bit guidance device as claimed in claim 1 wherein said piston means includes a well venting port.

6. A drill bit guidance device as claimed in claim 1 wherein said piston means includes a pressure relief means.

7. A drill bit guidance device comprising: a collar member, a piston means, said piston means having a paddle member, said paddle member pivotably joined to said collar member, said paddle member pivotable from a closed to an open position, said piston means including a gate means controlled by centrifugal force, said piston means also including fluid entry and exit ports, said collar member having a fluid conduit therethrough, said gate means oscillatable around said fluid conduit, a fluid supply means, said fluid supply means communicating with said fluid conduit whereby a fluid supply directed through said fluid conduit to said piston means pivots said paddle member to an open position.

8. A method of guiding a drill bit mechanism comprising: attaching a collar member having a piston means, fluid conduit with gate means and pivotable paddle to a drill bit, rotating said drill bit to form a well, forcing fluid through said collar member to the piston means, oscillating the gate means within the collar member around the fluid conduit, pivoting the paddle, contacting the well wall with the paddle to thereby cause the drill bit to carom from the contacted wall.

9. A method for guiding a drill bit as claimed in claim 8 wherein forcing fluid from the collar member to the piston means comprises the step of opening the piston means gate.

10. A method of guiding a drill bit as claimed in claim 9 wherein opening the piston means gate comprises the step of controlling the rotational speed of the drill bit.

11. A method of guiding a drill bit as claimed in claim 8 wherein pivoting the paddle comprises the step of forcing the paddle from the collar by the piston means.

12. A method of guiding a drill bit as claimed in claim 9 and including the step of venting fluid to the well.

13. A method of guiding a drill bit comprising the steps of attaching a collar having a fluid conduit, a piston means with a gate means and a pivotable paddle to a drill bit, rotating said drill bit at a moderate speed to form a well, forcing fluid through the collar member to the gate means, reducing the rotational speed of the drill bit, oscillating the gate means around the fluid conduit, opening the gate means, urging the piston means toward the paddle, pivoting the paddle towards the wall of the well, contact the wall with the paddle to guide the drill bit and venting fluid to the well.

* * * * *

UNITED STATES PATENT AND TRADEMARK OFFICE

CERTIFICATE OF CORRECTION

PATENT NO. : 4,416,339

DATED : November 22, 1983

INVENTOR(S) : Royce E. Baker et al.

It is certified that error appears in the above-identified patent and that said Letters Patent is hereby corrected as shown below:

On the sheet of drawing delete "Sheet 1 of 2".

Cancel "Sheet 2 of 2" in its entirety.

Signed and Sealed this

*Fourteenth* Day of *August 1984*

[SEAL]

*Attest:*

GERALD J. MOSSINGHOFF

*Attesting Officer*

*Commissioner of Patents and Trademarks*